US009347338B2

(12) United States Patent
Yamamoto et al.

(10) Patent No.: US 9,347,338 B2
(45) Date of Patent: May 24, 2016

(54) GAS COMPRESSOR

(71) Applicant: Hitachi Industrial Equipment Systems Co., Ltd., Chiyoda-ku, Tokyo (JP)

(72) Inventors: Kentaro Yamamoto, Tokyo (JP); Yuji Kamiya, Tokyo (JP); Masahiko Takano, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 0 days.

(21) Appl. No.: 13/962,620

(22) Filed: Aug. 8, 2013

(65) Prior Publication Data

US 2014/0102103 A1 Apr. 17, 2014

(30) Foreign Application Priority Data

Oct. 16, 2012 (JP) ..... 2012-228886

(51) Int. Cl.

| | |
|---|---|
| ***F01D 15/10*** | (2006.01) |
| ***F02C 6/00*** | (2006.01) |
| ***F01K 13/02*** | (2006.01) |
| ***F01K 15/00*** | (2006.01) |

(52) U.S. Cl.

CPC ..... *F01K 13/02* (2013.01); *F01K 15/00* (2013.01)

(58) Field of Classification Search

USPC ..... 290/2, 52, 40 B, 40 D, 40 R; 60/658, 657, 60/660

See application file for complete search history.

(56) References Cited

U.S. PATENT DOCUMENTS

| | | | | |
|---|---|---|---|---|
| 3,772,526 | A * | 11/1973 | Alwers | 290/38 R |
| 4,641,040 | A * | 2/1987 | Megnint | 290/52 |
| 7,245,032 | B2 * | 7/2007 | Willets et al. | 290/1 A |
| 7,944,094 | B2 * | 5/2011 | Hoffmann | 307/151 |
| 8,117,836 | B2 * | 2/2012 | Mori et al. | 60/409 |
| 8,916,985 | B2 * | 12/2014 | Oesterheld et al. | 290/52 |

(Continued)

FOREIGN PATENT DOCUMENTS

| | | | |
|---|---|---|---|
| CN | 101943168 | A | 1/2011 |
| CN | 202055876 | U1 | 11/2011 |

(Continued)

OTHER PUBLICATIONS

Chinese Office Action dated Jun. 9, 2015, with partial English translation (eleven (11) pages).

(Continued)

*Primary Examiner* — Julio C. Gonzalez Ramirez
(74) *Attorney, Agent, or Firm* — Crowell & Moring LLP

(57) ABSTRACT

A gas compressor includes a compressor unit having a compressor body for compressing gas and an electricity-generation device generating electricity by obtaining a driving force by vaporizing a working fluid utilizing exhaust heat generated by a compressing action in the compressor body and expanding the working fluid so as to utilize the power generated by the electricity-generation device as a power source, and includes a switch device switching between power from the electricity generation device and power from a commercial power supply to supply power to the power consumption equipment, and a control device detecting an electricity-generation amount or a value correlative to the electricity generation amount and switching between the powers by the switch device, thereby generating the power using exhaust heat as a heat source to surely drive an auxiliary machine by a simple configuration regardless of a shortage of the electricity generation amount.

18 Claims, 3 Drawing Sheets

(56) References Cited

U.S. PATENT DOCUMENTS

| | | | | |
|---|---|---|---|---|
| 2003/0038483 | A1* | 2/2003 | Klaar | 290/52 |
| 2004/0080164 | A1* | 4/2004 | McKelvey et al. | 290/52 |
| 2006/0066113 | A1* | 3/2006 | Ebrahim et al. | 290/52 |
| 2006/0254276 | A1* | 11/2006 | Sato et al. | 60/645 |
| 2009/0085312 | A1* | 4/2009 | Mori et al. | 280/6.157 |
| 2011/0000227 | A1* | 1/2011 | Kamiya | 62/6 |
| 2013/0156548 | A1 | 6/2013 | Takano et al. | |

FOREIGN PATENT DOCUMENTS

| | | | |
|---|---|---|---|
| JP | 8-189457 | A | 7/1996 |
| JP | 2002-115921 | A | 4/2002 |
| JP | 2007-6684 | A | 1/2007 |
| JP | 2011-12659 | A | 1/2011 |
| JP | 2012-67743 | A | 4/2012 |
| KR | 1020090040868 | A | 4/2009 |

OTHER PUBLICATIONS

Japanese-language Office Action issued in counterpart Japanese Application No. 2012-228886 dated Dec. 1, 2015 with partial English translation (Five (5) pages).

* cited by examiner

GAS COMPRESSOR

CROSS REFERENCE TO RELATED APPLICATION

This application claims priority to Japanese Patent Application No. JP 2012-228886, filed on Oct. 16, 2012, the entire contents of which are incorporated by reference herein.

BACKGROUND OF THE INVENTION

1. Field of the Invention

The present invention relates to a gas compressor and more particularly to a gas compressor which allows electricity generation by recovering exhaust heat from the gas compressor.

2. Description of the Related Art

It is said that the energy consumed by gas compressors such as air compressors and the like corresponds to about 20 to 25% of the energy consumed in the entire factory. Therefore, if it is allowed to recover exhaust heat from the gas compressors, the effect thereof will be increased. In particular, it has a large effect to recover and use the exhaust heat from the gas compressors in order to attain the goal of reducing carbon dioxide emissions arising from the problem of global warming simultaneously.

The gas compressor includes a compressor body for compressing a gas such as air or the like, a motor for driving the compressor body, a cooling system for cooling heat generated by compression in the compressor body and the like. In addition, in the gas compressor, assuming that power (electrical power) which is into the motor is 100%, a heat rate (exhaust heat rate) cooled by the cooling system corresponds to 90% or more of the input power and the exhaust heat is normally emitted into the atmosphere. This means that considerably much energy (the heat rate) is exhausted to the atmosphere. Although high efficiency of the compressor body and the motor is being promoted in order to reduce the exhaust heat rate, the effect thereof is limited to several percent and therefore effective utilization of the exhaust heat from the gas compressor is sought for.

Although, as for effective utilization of the exhaust heat from the gas compressor, examples such as utilization thereof for heating a room, effective use thereof for heating water, effective use thereof for preheating water supplied to a boiler and others are given, it is expected that practical use of the exhaust heat for generating electricity by effectively using the Rankine cycle that a low-temperature evaporating medium is used will be accelerated.

Incidentally, as related art of this kind, there is proposed a technology as described in Japanese Patent Application Laid-Open No. 2011-12659. The technology described in Japanese Patent Application Laid-Open No. 2011-12659 is the one that heat is exchanged between compressed air discharged from a compressor body and a working fluid in the Rankine cycle and the Rankine cycle is established by driving an expander with the vaporized working fluid, thereby generating electricity.

The technology described in Japanese Patent Application Laid-Open No. 2011-12659 is the one that the working fluid of the Rankine cycle is heated with compressed gas which has been compressed by the compressor body and has reached a high temperature and the expander is driven with the vaporized working fluid to generate electricity. That is, it allows effective utilization of the exhaust heat which has been discarded to the atmosphere so far. However, when it is thought to utilize the generated power as a power supply for driving an auxiliary machine such as a cooling fan or the like in a compressor unit which configures the gas compressor, an electricity generation amount (an amount of generated electricity) which is sufficient to drive the auxiliary machine such as the cooling fan or the like is not obtained for a while after start of operation of the gas compressor by the technology described in Japanese Patent Application Laid-Open No. 2011-12659.

In addition, since the exhaust heat rate is varied with a change in amount of the compressed gas generated by the gas compressor still after start of operation of the gas compressor, the electricity generation amount is also varied and a shortage of the electricity generation amount used for driving the auxiliary machine sometimes occurs.

Therefore, it has such a disadvantage that it is difficult to utilize the generated power for driving the auxiliary machine such as the cooling fan or the like in the compressor unit.

Incidentally, although it is also conceivable to store and use the generated power or to return it to a commercial power supply, the cost of equipment for storage is required in order to store the generated power and the cost of installation of a power conditioner is required in order to return it to the commercial power supply.

SUMMARY OF THE INVENTION

The present invention aims to obtain a gas compressor which generates electricity by using exhaust heat of the gas compressor as a heat source and utilizes the generated power for driving an auxiliary machine in the gas compressor and allows sure driving of the auxiliary machine by a simple configuration even in case of a shortage of the electricity generation amount.

In order to solve the above mentioned disadvantage, according to an embodiment of the present invention, there is provided a gas compressor which includes a compressor unit having a compressor body for compressing a gas and an electricity generation device for generating electricity by obtaining a driving force by vaporizing a working fluid utilizing exhaust heat generated by compressing action in the compressor body and expanding the working fluid and utilizes power generated by the electricity generation device as a power supply of power consumption equipment in the gas compressor, including a switch device for switching between the power generated by the electricity generation device and power obtained from a commercial power supply to supply the power to the power consumption equipment and a control device for detecting an electricity generation amount of the electricity generation device or a value correlative to the electricity generation amount and making the switch device switch between the power generated by the electricity generation device and the power obtained from the commercial power supply on the basis of at least one of the electricity generation amount and the correlative value.

The present invention has an advantage that such a gas compressor is obtained that the power is generated using the exhaust heat of the gas compressor as the heat source and the power generated is utilized for driving the auxiliary machine in the compressor unit, and driving of the auxiliary machine is surely allowed by a simple configuration even in case of a shortage of the electricity generation amount.

BRIEF DESCRIPTION OF THE DRAWINGS

The drawing figures depict one or more implementations in accord with the present teachings, by way of example only, not by way of limitation.

DETAILED DESCRIPTION OF THE PREFERRED EMBODIMENTS

In the following detailed description, numerous specific details are set forth by way of examples in order to provide a through understanding of the relevant teachings. However, it should be apparent to those skilled in the art that the present teachings may be practiced without such details. In other instances, well known methods, procedures, components, and/or circuitry have been described at a relatively high-level, without detail, in order to avoid unnecessarily obscuring aspects of the present teachings.

In the following, concrete embodiments of the gas compressor of the present invention will be described using the drawings. In each drawing, the parts designated by the same numerals denote the same or corresponding parts.

Embodiment 1

Figure 1:
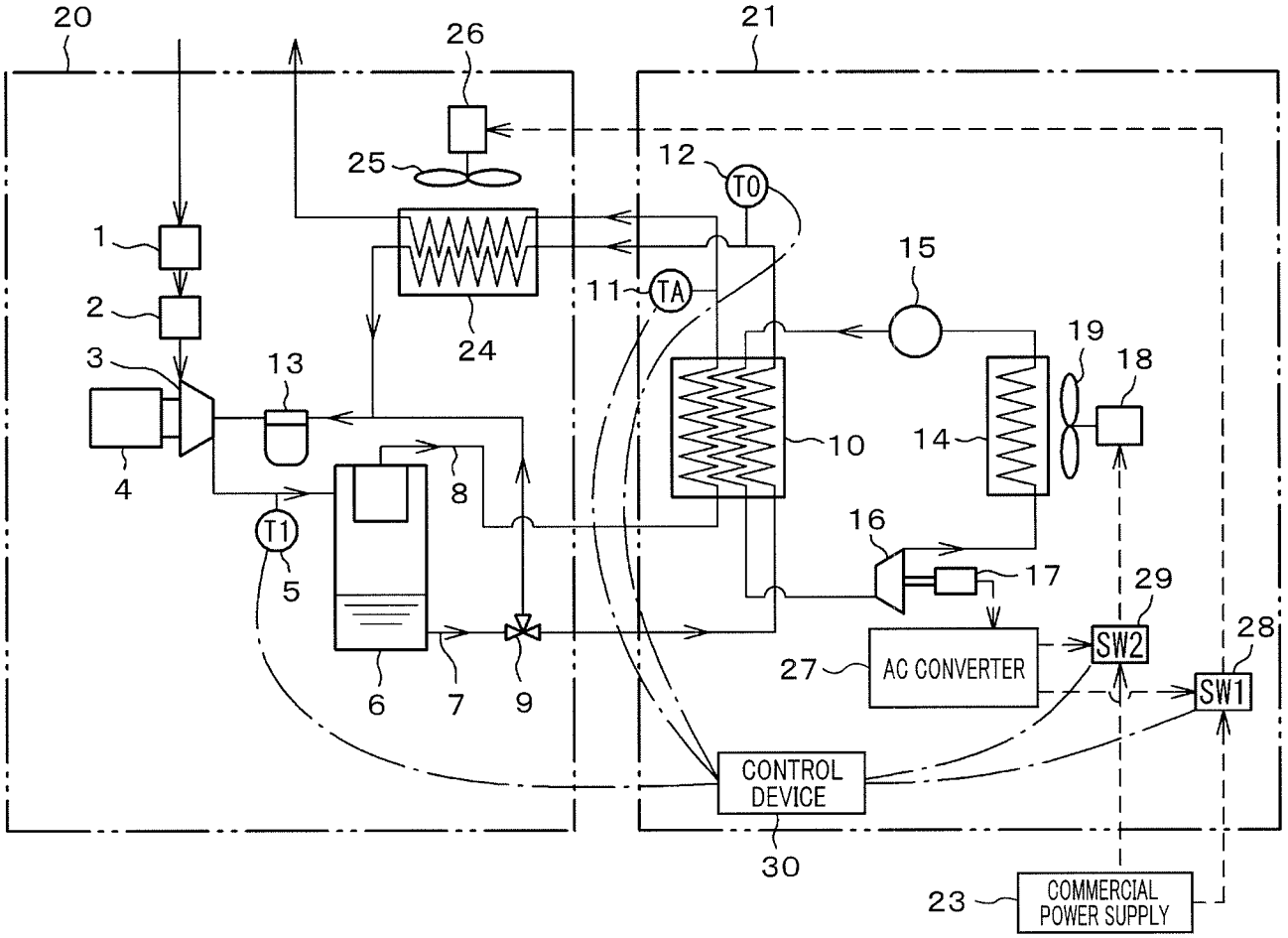
FIG. 1 is a system diagram illustrating an example of a gas compressor according to an embodiment 1 of the present invention.

FIG. 1 is a system diagram illustrating an example of a gas compressor according to an embodiment 1 of the present invention. This embodiment is the one that the present invention has been applied to an oil-cooled screw compressor which obtains compressed air by compressing air. In the drawing, 20 is a compressor unit and 21 is an electricity generation device. The compressor unit 20 and the electricity generation device 21 are contained in one housing and are configured as one oil-cooled gas compressor.

The compressor unit 20 is of an air-cooled system including a compressor body 3, an oil separator (an oil tank) 6, an air-cooled heat exchanger 24 and the like. In addition, the electricity generation device 21 includes an exhaust heat recovery heat exchanger 10, an expander 16, a condenser 14 and a circulating pump 15 which configure the Rankine cycle, and also includes an electric generator 17 which is driven by the expander and the like.

When the condenser 14 is to be formed as a water-cooled one, a cooling water system using a cooling tower for cooling circulating water is required. However, since in the present embodiment, an air-cooled system using a cooling fan 19 is adopted, it is allowed to eliminate the cooling water system for cooling the condenser 14. Accordingly, it is allowed to configure the gas compressor which includes the electricity generation device 21 as an electricity generation device built gas compressor of a closed system that the compressor unit 20 and the electricity generation device 21 are contained in one housing.

The compressor body 3 is configured to be driven by a main motor 4. When the compressor body 3 is driven by the main motor 4, air (a gas) introduced into the compressor unit 20 is sucked into the compressor body 3 via a suction filter 1 and a suction throttle valve 2 and is compressed. In addition, an oil (a lubricating oil) for cooling the compressed air is injected into the compressor body 3 while the sucked air is being compressed and the compressed air and the injected oil are discharged through a discharge port in the compressor body 3 in a mixed state. The oil-containing compressed air enters the oil separator 6 after its temperature has been detected by a discharge temperature sensor (a compressor body outlet temperature sensor) (T1) 5, and the lubricating oil contained in the compressed air is centrifugally separated and the oil separated from the compressed air is stored in a lower part of the oil separator 6.

The compressed air (compressed gas) separated from the oil in the oil separator 6 flows out through a gas pipe (an air pipe) 8 on an upper part of the oil separator 6 and flows into the exhaust heat recovery heat exchanger 10 of the electricity generation device 21. On the other hand, the oil staying in the lower part of the oil separator 6 flows out through an oil pipe 7 and flows into the exhaust heat recovery heat exchanger 10 when the oil temperature is high or directly flows toward the side of an oil filter 13 via a temperature adjustment valve 9 when the oil temperature is low, and is injected into a compression chamber in which compression of air is being performed in the compressor body 3 to cool the compressed air.

The exhaust heat recovery heat exchanger 10 is configured as an evaporator for evaporating a working fluid (water or a refrigerant) of the Rankine cycle and the working fluid of the Rankine cycle circulates through it. Then, the working fluid is heated by being subjected to heat exchange with the high-temperature compressed air (compressed gas) and the oil and is vaporized. In addition, in the exhaust heat recovery heat exchanger 10, the compressed air and the oil are cooled with the working fluid and flow out of the exhaust heat recovery heat exchanger 10. Then, the compressed air flows into the air-cooled heat exchanger 24 after its temperature has been detected by a gas outlet temperature sensor (TA) 11, and the oil flows into the air-cooled heat exchanger 24 after its temperature has been detected by an oil outlet temperature sensor (TO) 12.

The compressed air flown into the air-cooled heat exchanger 24 is further cooled with the air sent from a cooling fan 25 in the air-cooled heat exchanger 24 and then is supplied to a demander on the outside of the compressor unit 20. The cooling fan 25 of the air-cooled heat exchanger 24 is driven by a fan motor 26.

On the other hand, the oil flown into the air-cooled heat exchanger 24 is also further cooled with the air sent from the cooling fan 25 in the air-cooled heat exchanger 24 and then is injected into the compression chamber in which compression of air is being performed in the compressor body 3 to cool the compressed air.

As described above, the electricity generation device 21 includes the exhaust heat recovery heat exchanger 10, the expander 16, the condenser 14 and the circulating pump 15 which configure the Rankine cycle and also includes the electric generator 17 which is driven by the expander 16 and the like. That is, in the exhaust heat recovery heat exchanger 10, the working fluid is heated and vaporized by heat exchange with the compressed air and the oil and the working fluid which has been vaporized by the exhaust heat recovery heat exchanger 10 is expanded by the expander 16 to produce a driving force. The working fluid gone out of the expander 16 is cooled with the air sent from the cooling fan 19 and is liquefied by the condenser 14. The working liquid which has been liquefied by the condenser 14 is pressure-risen by the circulating pump 15 and is supplied to the exhaust heat recovery heat exchanger 10 to configure the Rankine cycle.

The electric generator 17 is directly connected to the expander 6. Although a DC generator and an AC generator are included in the electric generator, an example that the DC generator is used will be described in the present embodiment. When the power generator 17 is the DC generator, the power obtained is DC power. In order to supply the DC power to the fan motors 26 and 18 which are driven by a commercial power supply 23, it is desired to convert it into the power which matches the commercial power supply 23 in frequency. Therefore, the DC power from the electric generator 17 is converted from direct current to alternate current by an AC converter 27.

In the present embodiment, the AC power which has been transmitted from the AC converter 27 is utilized as a power source of the fan motor 26 for driving the cooling fan 25 of the air-cooled heat converter 24 via a changeover switch (SW1) 28. The fan motor 26 is also connected to the commercial power supply 23 via the changeover switch 28 so as to change over the power source of the fan motor 26 by the changeover switch 28.

In addition, in the present embodiment, it is also allowed to utilize the AC power which has been transmitted from the AC converter 27 as the power source of the fan motor 18 for driving the cooling fan 19 of the condenser 14 via a changeover switch (SW2) 29. Therefore, the fan motor 18 is also connected to the commercial power supply 23 via the changeover switch 29 so as to change over the power source of the fan motor 18 by the changeover switch 28.

The changeover switches (changeover devices) 28 and 29 are controlled by a control device 30. In addition, also information on temperatures detected by the discharge temperature sensor 5, the gas outlet temperature sensor 11 and the oil outlet temperature sensor 12 is input into the control device 30.

Since the temperatures of the compressed air and the oil flowing into the exhaust heat recovery heat exchanger 10 are low immediately after start of operation (activation) of the gas compressor, the heat exchange amount (the amount of heat exchanged by) of the exhaust heat recovery heat exchanger 10 is small. Accordingly, electricity generation by the electricity generation device 21 is not expected or even if electricity was generated, the amount thereof would be too small as the power for driving the fan motors 26 and 18. Therefore, in such a situation as mentioned above, the power is supplied from the commercial power supply 23 to the fan motors 26 and 18 by the changeover switches 28 and 29. That is, the changeover switches 28 and 29 are controlled by the control device 30 such that the AC converter 27 side is turned OFF and the commercial power supply 23 side is turned ON.

Since the temperatures of the compressed air and the oil flowing into the exhaust heat recovery heat exchanger 10 are gradually increased as the time elapses after start of operation, the heat exchange amount of the exhaust heat recovery heat exchanger 10 is increased and the electricity generation amount of the electric generator 16 is also increased accordingly.

Thus, in the present embodiment, the electricity generation amount of the electricity generation device 21 or a value correlative to the electricity generation amount is detected and the control device 30 controls the switch devices (the changeover switches 28 and 29) to switch between the power generated by the electricity generation device 21 and the power obtained from the commercial power supply 23 on the basis of at least one of the electricity generation amount and the correlative value. That is, in the example illustrated in FIG. 1, a value detected by the discharge temperature sensor 5 is used as the value correlative to the electricity generation amount, and the control device 30 controls the changeover switches 28 and 29 on the basis of the temperature (the value) of the oil containing compressed gas detected by the discharge temperature sensor 5 such that the AC converter 27 side is turned ON and the commercial power supply 23 side is turned OFF when the value detected by the discharge temperature sensor 5 is higher than a value (a set temperature) which has been set in advance. Thus, it is allowed to drive the fan motors 18 and 26 by utilizing the power generated by the electricity generation device 21.

On the other hand, when the value detected by the discharge temperature sensor 5 is lower than the value (the set temperature) which has been set in advance, the control device 30 decides that the electricity generation amount is small and is insufficient as the power to be supplied to the fan motors 18 and 26 and controls the changeover switches 28 and 29 such that the AC converter 27 side is turned OFF and the commercial power supply 23 side is turned ON.

A relation between the temperature detected by the discharge temperature sensor 5 and the electricity generation amount of the electricity generation device 21 is obtained in advance in an experiment or by an arithmetic operation and a temperature at which the electricity generation amount which is sufficient as the power to be supplied to the fan motors 18 and 26 is stored in advance in the control device 30 as the set temperature.

Incidentally, although in the above-mentioned embodiment, an example that the changeover switches 28 and 29 are controlled by the control device 30 in accordance with the temperature (the value) detected by the discharge temperature sensor 5 has been described, the changeover switches 28 and 29 may be controlled by the control device 30 by using a temperature (a value) detected by the gas outlet temperature sensor (TA) 11 or the oil outlet temperature sensor (TO) 12, or by using the temperatures detected by both of the gas outlet temperature sensor 11 and the oil outlet temperature sensor 12 together with the temperatures detected by the discharge temperature sensor 5. The control device 30 is allowed to obtain the electricity generation amount of the electricity generation device 21 by an arithmetic operation on the basis of a difference between the temperature detected by the discharge temperature sensor 5 and the temperature detected by the gas outlet temperature sensor 11 and/or a difference between the temperature detected by the discharge temperature sensor 5 and the temperature detected by the oil outlet temperature sensor 12 by configuring as mentioned above.

Therefore, it is allowed to rapidly supply the power generated by the electricity generation device 21 to the fan motors 18 and 26 when the electricity generation amount reaches a predetermined value and it is also allowed to rapidly switch to the commercial power supply 23 in case of a shortage of the electricity generation amount by controlling the changeover switches 28 and 29 in accordance with the obtained electricity generation amount. Thus, it is allowed to maximally utilize the power generated by the electricity generation device 21 and it is also allowed to avoid the shortage of the power to be supplied to the fan motors 18 and 26.

In addition, although in any of the above-mentioned examples, the value detected by the discharge temperature sensor 5 is used for controlling the changeover switches (the switch devices) 28 and 29 by the control device 30, a timer may be included in the control device 30 so as to control the changeover switches 28 and 29 by the control device 30 on the basis of a time elapsed after activation of the compressor in place of use of the above-mentioned values.

That is, the time elapsed after activation of the compressor and a change in electricity generation amount of the electric generator 17 relative to the elapsed time are obtained in advance in an experiment or the like, and a time taken until the electricity generation amount which is sufficient as the power for driving the fan motors 26 and 18 is obtained is stored as a predetermined time in the control device 30. Therefore, in this example, the elapsed time after activation of the compressor is used as the value correlative to the electricity generation amount.

Since it is allowed to decide that the predetermined time has elapsed after activation of the compressor by the timer or the like which is built into the control device 30 and power supply from the electric generator 17 to the fan motors 18 and 26 is allowed after the predetermined time has elapsed by configuring as mentioned above, the control device 30 controls the changeover switches 28 and 29 such that the AC converter 27 side is turned ON and the commercial power supply 23 side is turned OFF. Control is allowed by a simple configuration by controlling the changeover switches 28 and 29 using the time elapsed after activation of the compressor as mentioned above.

The control device 30 of the type of controlling the switching operations of the changeover switches 28 and 29 on the basis of the time elapsed after activation of the compressor is effective when the electricity generation amount of the electricity generation device 21 is typically sufficient as the power used for driving the fan motors 18 and 26 until the compressor is stopped when the predetermined time has elapsed after activation of the compressor. In a case where a shortage of the electricity generation amount sometime occurs, the control device 30 may control the changeover switches 28 and 29 by using also the temperature detected by the discharge gas temperature sensor 5.

In the above-mentioned embodiment, an example that the power generated by the electricity generation device 21 is utilized as the power source of the fan motor 26 for driving the cooling fan 25 of the air-cooled heat exchanger 24 and is also utilized as the power source of the fan motor 18 for driving the cooling fan 19 of the condenser 14 simultaneously has been described. However, the power generated by the electric generator 21 may be utilized as the power source of either of the fan motors 26 and 18 in a relationship with the generated energy. In the above-mentioned case, the changeover switch may be disposed solely on the side where the generated power is utilized. As an alternative, both of the changeover switches 28 and 29 may be disposed in the same manner as that in FIG. 1 and the changeover switches 28 and 29 maybe controlled by the control device 30 such that the generated power is supplied to both or one of the fan motors 18 and 26 in accordance with the electricity generation amount and requirements.

In addition, although in the above-mentioned embodiment, an example that the power generated by the electricity generation device 21 is utilized as the power source of the fan motor 26 of the cooling fan 25 for sending air to the air-cooled heat exchanger 24 in the gas compressor and/or as the power source of the fan motor 18 of the cooling fan 19 for sending air to the condenser 14 which configures the Rankine cycle has been described, utilization of the generated power is not limited to the above-mentioned fan motors. That is, when power consumption equipment, for example, an auxiliary machine such as a dryer or the like is present in the gas compressor, the generated power may be supplied to the auxiliary machine. In the above-mentioned case, a changeover switch may be also disposed so as to supply the power to the auxiliary machine by switching between the generated power supply and the commercial power supply as in the case of power supply to the fan motors 18 and 26. In addition, the above-mentioned generated power may be also supplied to the main motor 4 as an auxiliary power supply for the main motor 4 for driving the compressor body 3.

Further, in the above-mentioned embodiment, the control device 30 controls to switch between the generated power and the power obtained from the commercial power supply by detecting the electricity generation amount or the value correlative to the electricity generation amount. However, when the temperatures detected by the gas outlet temperature sensor 11 and the oil outlet temperature sensor 12 are lower than the set temperature which has been defined in advance, it is allowed to return the oil of an appropriate temperature to the compressor body 3 and to supply the compressed air (the compressed gas) of an appropriate temperature to the demander by stopping the cooling fans 25 and 19 by the control device 30.

In addition, although in the above-mentioned embodiment, a case that the DC generator is used as the electric generator 17 has been described, use of an AC generator is also allowed. Although the AC converter 27 is eliminated when using the AC generator, it is required for an AC power supply obtained from the AC generator to have the same frequency as the commercial power supply.

Incidentally, the gas compressor of the present invention is not limited to the oil-cooled gas compressor as in the above-mentioned embodiment 1 and the present invention may be also embodied even in the form of an oil-free (no-oil-supply) gas compressor almost similarly. The oil-free gas compressor is of the type including a compressor body for compressing a gas such as air or the like, a main motor (a drive unit) for driving the compressor body, cooling equipment for cooling the compressor body and the gas discharged from the compressor body and the like. Then, when the oil-free gas compressor is used, it is allowed to embody the present invention almost similarly to the embodiment 1 by configuring it such that the power is generated by an electricity generation device which utilizes the Rankine cycle by using exhaust heat from a coolant for cooling the compressor body and the compressed gas discharged from the compressor body and the generated power is supplied to the power consumption equipment.

Embodiment 2

Figure 2:
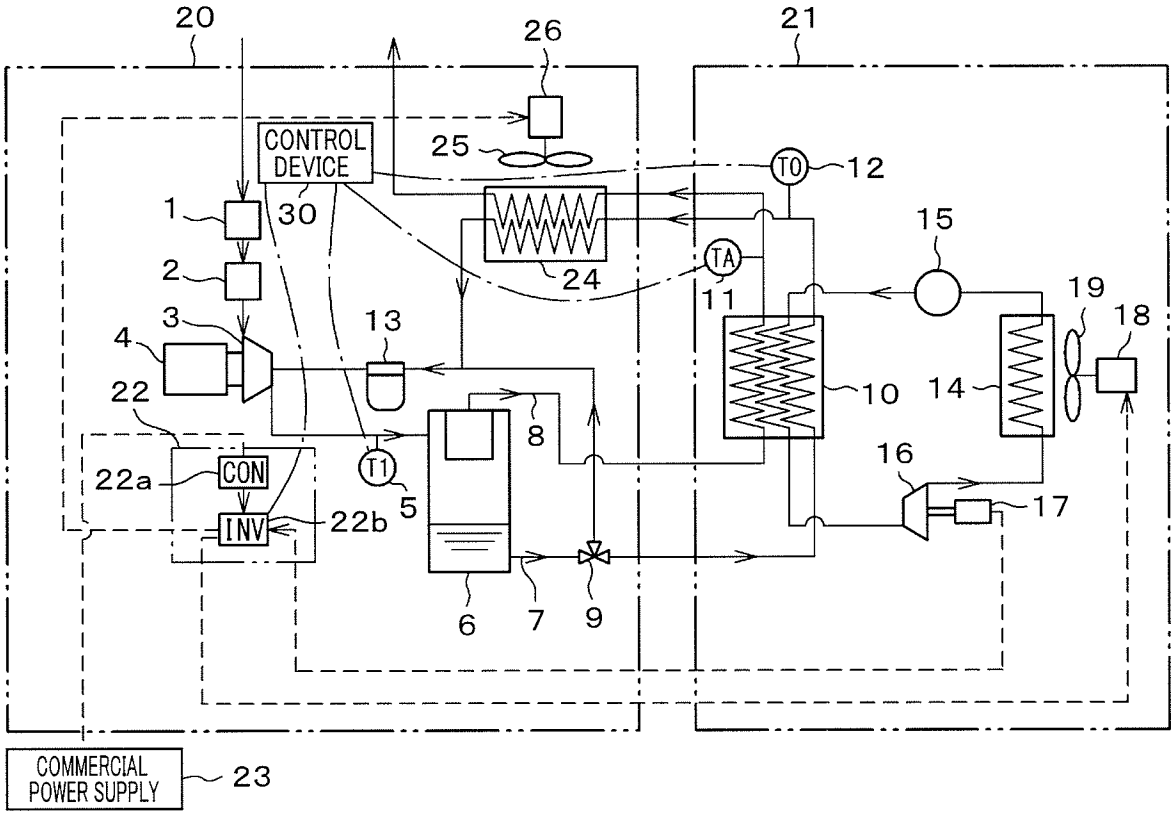
FIG. 2 is a system diagram illustrating an example of a gas compressor according to an embodiment 2 of the present invention.

An example of a gas compressor according to an embodiment 2 of the present invention will be described with reference to a system diagram in FIG. 2. In FIG. 2, the parts designated by the same numerals as those in FIG. 1 indicate the same or corresponding parts and description of overlapped parts is omitted.

While, in the embodiment 1, the example that the cooling fans 19 and 25 are constant-speed machines the numbers of rotations of which are constant has been described, the embodiment 2 is the one that the present invention has been applied to an oil-cooled screw compressor (gas compressor) that the numbers of rotations of the cooling fans 19 and 25 are variable-speed-controlled by an inverter 22. That is, the power obtained from the commercial power supply 23 is supplied to the cooling fans 19 and 25 via the inverter 22.

The power obtained from the commercial power supply 23 is AC-to-DC converted by a converter part 22*a* of the inverter 22, is converted to AC current of an arbitrary frequency by an inverter part 22*b*, and is supplied to the fan motors 18 and 26 of the cooling fans 19 and 25. In the inverter part 22*b*, the power of an arbitrary frequency is generated on the basis of a command from the control device 30, and the fan motors 18 and 26 are controlled by the control device 30 so as to have arbitrary numbers of rotations, thereby adjusting cooling amounts of the condenser 14 and the air-cooled heat exchanger 24.

The power generated by the electric generator (the DC generator in the present embodiment) of the electricity generation device 21 is supplied to the inverter part 22*b* of the inverter 22 without passing through the AC converter 27 in the embodiment 1. Therefore, the DC power supplied from the commercial power supply 23 via the converter part 22*a* and the DC power from the electric generator 17 are supplied to the inverter part 22*b*. Then, a switch device for switching between the DC power from the commercial power supply 23 and the DC power from the electric generator 17 is included in the inverter part 22*b*. The switch device is also controlled by the control device 30 on the basis of at least one of the electricity generation amount of the electricity generation device 21 and the value correlative to the electricity generation amount as to which one of the power from the commercial power supply 23 and the power from the electric generator 17 is to be utilized similarly to the embodiment 1. Switching is performed in the same manner as that in the embodiment 1.

For example, when it is decided from the electricity generation amount or the value correlative to the electricity generation amount that the electricity generation amount sufficient to drive the cooling fans 19 and 25 is obtained on the basis of temperature information detected by the discharge temperature sensor 5, the switch device is controlled by the control device 30 so as to supply the power from the electric generator 17 to the fan motors 18 and 26. On the other hand, when the electricity generation amount is decided to be insufficient for driving the cooling fans 19 and 25, the switch device is controlled by the control device 30 so as to supply the power from the commercial power supply 23 to the fan motors 18 and 26.

In addition, similarly to the embodiment 1, the control device 30 may obtain the electricity generation amount of the electricity generation device 21 by using the temperatures detected by the gas outlet temperature sensor 11 and the oil outlet temperature sensor 12 together with the temperature detected by the discharge temperature sensor 5 so as to control the switching operation of the switch device in accordance with the obtained electricity generation amount. Further, the time elapsed after activation of the compressor may be used as the value correlative to the electricity generation amount and the switching operation of the switch device may be controlled by the control device 30 on the basis of the elapsed time.

In case of the oil-cooled gas compressor which obtains the compressed air by compressing air, it is preferable that the compressed air to be supplied to the demander be supplied after setting it to an appropriate temperature and the oil to be returned to the compressor body 3 of the oil-cooled gas compressor be returned after setting it to an appropriate temperature. Thus, in the present embodiment, the numbers of rotations of the cooling fans 19 and 25 are controlled by the inverter 22 in order to set the compressed air and the oil to the appropriate temperatures. In addition, the inverter part 22*b* generates two frequencies so as to individually control the numbers of rotations of the cooling fans 19 and 25.

That is, the temperature of the compressed air gone out of the exhaust heat recovery heat exchanger 10 is detected by the gas outlet temperature sensor 11, the temperature of the oil gone out of the exhaust heat recovery heat exchanger 10 is detected by the oil outlet temperature sensor 12, and the number of rotations of the cooling fan 25 is controlled by the control device 30 via the inverter part 22*b* such that the above-mentioned temperatures reach a predetermined temperature (or a temperature within a predetermined temperature range).

The cooling fan 19 of the power generation device 21 is controlled in number of rotations in accordance with the temperature of the discharge temperature sensor 5, that is, it is operated with a rated number of rotations when the detected discharge temperature is not less than the predetermined temperature and is controlled so as to obtain a maximum electricity generation amount from the electricity generation device 21, or is controlled in number of rotations so as to attain the electricity generation amount which is sufficient as the electric energy to be supplied to the power consumption equipment (in this example, the cooling fans 19 and 25) to which the generated power is to be supplied in the gas compressor. While, when the temperatures detected by the gas outlet temperature sensor 11 and the oil outlet temperature sensor 12 are not more than the predetermined temperature (or a temperature within the predetermined temperature range), the number of rotations of the cooling fan 19 is controlled such that the detected temperatures reach the predetermined temperature (or a temperature within the predetermined temperature range).

As described above, the cooling fans 19 and 25 are controlled such that the compressed air is supplied to the demander after setting it to the appropriate temperature and the oil to be returned to the compressor body 3 is returned after setting it to the appropriate temperature. That is, the numbers of rotations of the cooling fans 19 and 25 are controlled by the control device 30 such that the greatest possible electricity generation amount or a required electricity generation amount is obtained from the electricity generation device 21, after giving priority to satisfying the above-mentioned condition. Incidentally, the configuration of the cooling fan 19 may be simplified such that it is typically operated at a constant speed while the compressor body 3 is being rotated and is stopped when the compressor body 3 is stopped.

Since the embodiment 2 is configured such that the same advantages as those of the embodiment 1 are obtained and the numbers of rotations of the cooling fans 19 and 25 are controlled as mentioned above, such a high-performance gas compressor is obtained that the compressed air to be supplied to the demander is supplied after setting it to the appropriate temperature and the oil to be returned to the compressor body 3 is returned after setting it to the appropriate temperature. In addition, it is also allowed to obtain the greatest possible electricity generation amount by operating the cooling fan 19 of the electricity generation device 21 with a higher number of rotations so as to suppress the number of rotations of the cooling fan 25 to the lowest possible value. In addition, in the present embodiment, since the DC power generated by the electric generator 17 is converted to the AC power by supplying it to the inverter part 22*b*, such an advantage is also obtained that the AC converter 27 as described in the embodiment 1 is eliminated.

Incidentally, the DC power generated by the electric generator 17 of the electricity generation device 21 may be supplied to a DC part of the inverter 22, that is, to between the converter part 22*a* and the inverter part 22*b*. In the above-mentioned case, a switch device for switching between the DC power supplied from the commercial power supply 23 via the converter part 22*a* and the DC power supplied from the electric generator 17 is included in the DC part so as to control the switching operation of the switch device by the control device 30.

Since other configurations are the same as those of the embodiment in FIG. 1, description thereof is omitted.

Embodiment 3

Figure 3:
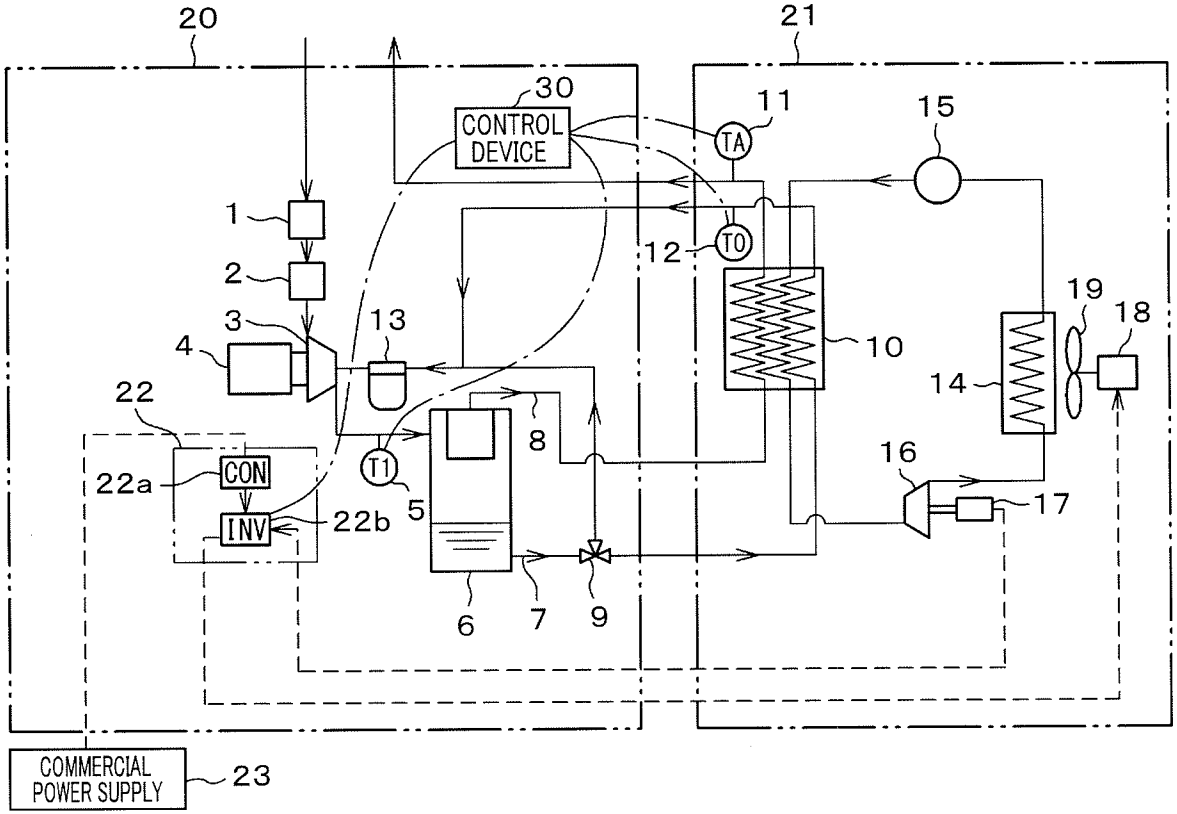
FIG. 3 is a system diagram illustrating an example of a gas compressor according to an embodiment 3 of the present invention.

An example of a gas compressor according to an embodiment 3 of the present invention will be described with reference to a system diagram in FIG. 3. In FIG. 3, the parts designated by the same numerals as those in FIG. 1 and FIG. 2 indicate the same or corresponding parts and description of overlapped parts is omitted.

In the gas compressors according to the embodiments 1 and 2, since two heat exchangers, that is, the exhaust heat recovery heat exchanger 10 and the air-cooled heat exchanger 24 are serially disposed, the compressed air and the oil discharged from the compressor body 3 are cooled by the exhaust heat recovery heat exchanger 10 and then cooled by the air-cooled heat exchanger 24. That is, the compressed air and the oil are cooled two times as mentioned above.

On the other hand, in the embodiment 3, the configuration is simplified by cooling the compressed air and the oil solely by the exhaust heat recovery heat exchanger 10 so as to eliminate the air-cooled heat exchanger 24, the cooling fan 25 and the fan motor 26 as illustrated in FIG. 3. In addition, since in the present embodiment, the fan motor 18 of the electricity generation device is solely used as the fan motor, it is also allowed to simplify the configuration of the inverter part 22*b*.

That is, the embodiment 3 is the same as the embodiment 2 in that the inverter part 22 is included and the power generated by the electric generator (the DC generator) 17 of the electricity generation device 21 is supplied to the inverter part 22*b* of the inverter 22. Similarly, the power obtained from the commercial power supply 23 is also supplied to the inverter part 22*b* after AC-to-DC converted by the converter part 22*a* of the inverter 22.

Therefore, the inverter part 22*b* includes a switch device for switching between the DC power from the commercial power supply 23 and the DC power from the electric generator 17 similarly to the embodiment 2. This switch device is also controlled by the control device 30 as to which one of the power from the commercial power supply 23 and the power from the generator 17 is to be utilized on the basis of at least one of the electricity generation amount of the electricity generation device 23 and the value correlative to the electricity generation amount similarly to the embodiments 1 and 2. Since switching is performed in the same manner as that in the embodiments 1 and 2, description thereof is omitted.

The power is converted to DC power of an arbitrary frequency by the inverter part 22*b* and is supplied to the fan motor 18 of the cooling fan 19. That is, in the inverter part 22*b*, the power of an arbitrary frequency is generated on the basis of a command from the control device 30, and the fan motor 18 is controlled by the control device 30 to have an arbitrary number of rotations so as to allow adjustment of the cooling amount of the condenser 14.

While in the embodiment 2, the inverter part 22*b* generates the two frequencies so as to individually control the numbers of rotations of the cooling fans 19 and 25, in the embodiment 3, since the cooling fan 25 is eliminated and therefore the inverter part 22*b* is allowed to generate one frequency for controlling the cooling fan 19, also the configuration of the inverter part 22*b* is simplified.

In case of the oil-cooled gas compressor that air is compressed to obtain the compressed air, it is preferable that the compressed air to be supplied to the demander be supplied after setting it to an appropriate temperature and the oil to be returned to the compressor body 3 of the oil-cooled gas compressor be returned also after setting it to an appropriate temperature. Accordingly, in the embodiment 3, in order to set the compressed air and the oil to the appropriate temperatures, the temperature of the compressed air from the exhaust heat recovery heat exchanger 10 is detected by the gas outlet temperature sensor 11, the temperature of the oil from the exhaust heat recovery heat exchanger 10 is detected by the oil outlet temperature sensor 12, and the number of rotations of the cooling fan 19 is controlled by the control device 30 via the inverter part 22*b* such that the temperatures reach a predetermined temperature (or a temperature within a predetermined temperature range).

Incidentally, the number of rotations of the cooling fan may be controlled on the basis of the temperature detected by the oil outlet temperature sensor 12 preferentially to the temperature detected by the gas outlet temperature sensor 11 or on the basis of the temperature detected simply by the oil outlet temperature sensor 12. That is, because the compressed air and the oil are cooled by the same exhaust heat recovery heat exchanger 10 and therefore the temperatures of the compressed air and oil after cooled become almost the same as each other, the cooling fan 19 need not necessarily be controlled on the basis of the temperature of the compressed air. In addition, it is also allowed to control the cooling fan 19 on the basis of the temperature detected by the gas outlet temperature sensor 11 preferentially to the temperature detected by the oil outlet temperature sensor 12.

As described above, the cooling fan 19 is controlled such that the compressed air is supplied to the demander after setting it to the appropriate temperature and the oil to be returned to the compressor body 3 is returned after setting it to the appropriate value and control that priority is given to satisfying this condition is performed. Thus, the electricity generation amount of the electricity generation device 21 depends on the number of rotations of the cooling fan 19 and the electricity generation amount is obtained from a difference between the temperature detected by the discharge temperature sensor 5 and the temperature detected by the gas outlet temperature sensor 11 and a difference between the temperature detected by the discharge temperature sensor 5 and the temperature detected by the oil outlet temperature sensor 12 by arithmetic operations.

According to the present embodiment, since the same advantages as those of the embodiment 2 are obtained and the air-cooled heat exchanger 24, the cooling fan 25 and the fan motor 26 are eliminated, the configuration is greatly simplified and the configuration of the inverter part 22*b* is also simplified, and therefore it is allowed to promote cost reduction more remarkably than the embodiment 2.

In addition, more electricity generation is allowed by the electricity generation device 21 while supplying the compressed air to the demander after setting it to the appropriate temperature and returning the oil to be returned to the compressor body after setting it to the appropriate temperature. That is, this is because the embodiment 3 is configured to recover exhaust heat which has been discarded by the air-cooled heat exchanger 24 in the embodiments 1 and 2 and therefore it is allowed to recover more exhaust heat by the exhaust heat recovery heat exchanger 10.

Since other configurations are the same as those of the embodiments 1 and 2, description thereof is omitted.

According to each of the above-mentioned embodiments of the present invention, it is allowed to obtain the power by operating the Rankine cycle using the exhaust heat of the gas compressor as the heat source and to utilize the generated power for driving the auxiliary machine (the power consumption equipment) in the gas compressor. In addition, the gas compressor in each of the embodiments of the present invention includes the control device which detects the electricity generation amount of the electricity generation device or the value correlative to the electricity generation amount and switches between the power generated by the electricity generation device and the power obtained from the commercial power supply on the basis of the detected value. Therefore, regardless of the gas compressor of the type that the shortage sometimes occurs in the electricity generation amount for driving the auxiliary machine due to a variation in exhaust heat amount, it is allowed to surely drive the auxiliary machine by switching to the commercial power supply in case of the electricity generation amount shortage. As described above, according to the embodiments of the present invention, it is allowed to generate the power by using the exhaust heat from the gas compressor as the heat source and to utilize the generated power for driving the auxiliary machine in the gas compressor, and moreover it is allowed to readily implement each of gas compressors as mentioned above by a simple configuration.

Incidentally, the present invention is not limited to the above-mentioned embodiments and includes various modified examples. In addition, the above-mentioned embodiments have been described in detail for better understanding of the present invention and are not invariably limited to those including all the configurations which have been described above. Further, part of a certain embodiment may be replaced with a configuration of another embodiment, and a configuration of another embodiment may be added to a configuration of a certain embodiment. In addition, another configuration may be added to, deleted from and replaced with part of a configuration of each embodiment.

What is claimed is:

1. A gas compressor including a compressor unit having a compressor body for compressing a gas and an electricity generation device for generating electricity by obtaining a driving force by vaporizing a working fluid utilizing exhaust heat generated by compressing action in the compressor body and expanding the working fluid and utilizing power generated by the electricity generation device as a power supply of power consumption equipment in the gas compressor, comprising:

a discharge temperature sensor for detecting a temperature of a compressed gas discharged from the compressor body, a switch device for switching between the power generated by the electricity generation device and power obtained from a commercial power supply to supply the power to the power consumption equipment, and a control device for making the switch device switch between the power generated by the electricity generation device and the power obtained from the commercial power supply on the basis of the temperature detected by the discharge temperature sensor;

wherein the control device switches to supply the power from the commercial power supply to the power consumption equipment after activation of the gas compressor and to supply the power from the electricity generation device to the power consumption equipment when the temperature detected by the discharge temperature sensor becomes not less than a set temperature which has been set in advance.

2. The gas compressor according to claim 1, wherein the gas compressor is an oil-cooled gas compressor including an oil separator for separating oil from the compressed gas discharged from the compressor body, a gas pipe for sending the compressed gas from which the oil has been separated by the oil separator to a demander and an oil pipe for returning the oil separated by the oil separator to the compressor, and the power generation device configures a Rankine cycle by including an exhaust heat recovery heat exchanger for exchanging heat between the oil flowing through the oil pipe and the working fluid to cool the oil and to heat and vaporize the working fluid, an expander which is driven by expanding the working fluid vaporized by the exhaust heat recovery heat exchanger, a condenser for cooling and condensing the working fluid from the expander, and a circulating pump for supplying the working fluid condensed by the condenser to the exhaust heat recovery heat exchanger, and includes an electric generator driven by the expander to generate electricity.

3. The gas compressor according to claim 2, further comprising:

an air-cooled heat exchanger for cooling the oil flowing through the oil pipe; and a cooling fan for sending cooling air to the air-cooled heat exchanger, wherein the exhaust heat recovery heat exchanger is disposed upstream of the air-cooled heat exchanger.

4. The gas compressor according to claim 3, wherein the air-cooled heat exchanger is adapted to cool also the compressed gas flowing through the gas pipe, and the exhaust heat recovery heat exchanger is adapted to recover heat also from the compressed gas flowing through the gas pipe.

5. The gas compressor according to claim 4, further comprising:

an oil outlet temperature sensor for detecting a temperature of the gas gone out of the exhaust heat recovery heat exchanger, and a gas outlet temperature sensor for detecting a temperature of the compressed gas gone out of the exhaust heat recovery heat exchanger.

6. The gas compressor according to claim 5, wherein the power generated by the electricity generation device and the power obtained from the commercial power supply are switched by the control device via the switch device in accordance with the temperature of the oil detected by the oil outlet temperature sensor, the temperature of the compressed gas detected by the gas outlet temperature sensor, and a compressor discharge temperature detected by the discharge temperature sensor.

7. The gas compressor according to claim 5, wherein the control device arithmetically operates a generation amount of electricity generated by the electricity generation device on the basis of the compressor discharge temperature detected by the discharge temperature sensor, the temperature of the oil detected by the oil outlet temperature sensor and the temperature of the compressed gas detected by the gas outlet temperature sensor, and when the electricity generation amount is not less than an electricity generation amount which has been defined in advance, supplies the generated power from the electricity generation device to the power consumption equipment.

8. The gas compressor according to claim 3, wherein the power consumption equipment is a fan motor for driving the cooling fan.

9. The gas compressor according to claim 8, wherein the electric generator is a DC generator, the number of rotations of the fan motor for driving the cooling fan is controlled by supplying the power from the commercial power supply to the fan motor via an inverter, also DC power generated by the electricity generation device is supplied to the inverter, and the switch device for switching between the power generated by the electricity generation device and the power obtained from the commercial power supply so as to supply the power to the fan motor is incorporated into the inverter.

10. The gas compressor according to claim 9, wherein the control device controls the number of rotations of the cooling fan via the inverter on the basis of the temperature of the oil detected by the oil outlet temperature sensor such that the temperature of the oil reaches a predetermined temperature or a temperature within a predetermined temperature range.

11. The gas compressor according to claim 10, wherein the condenser of the electricity generation device is cooled with air sent from the cooling fan, a number of rotations of the cooling fan for the condenser is also controlled by the inverter, the inverter generates two frequencies so as to individually control the numbers of rotations of the cooling fan for the air-cooled heat exchanger and the cooling fan for the condenser, and the cooling fan for the condenser is controlled on the basis of the temperature of the oil detected by the oil outlet temperature sensor.

12. The gas compressor according to claim 2, wherein the condenser of the electricity generation device is cooled with air sent from the cooling fan, and the power consumption equipment is a fan motor for driving the cooling fan.

13. The gas compressor according to claim 12, wherein the electric generator is a DC generator, the number of rotations of the fan motor for driving the cooling fan is controlled by supplying the power from the commercial power supply to the fan motor via an inverter, also DC power generated by the electricity generation device is supplied to the inverter, and the switch device for switching between the power generated by the electricity generation device and the power obtained from the commercial power supply so as to supply the power to the fan motor is incorporated into the inverter.

14. The gas compressor according to claim 13, further comprising:

an oil outlet temperature sensor for detecting the temperature of oil gone out of the exhaust heat recovery heat exchanger, wherein the number of rotations of the cooling fan for the condenser is controlled by the inverter such that the temperature detected by the oil outlet temperature sensor reaches a predetermined temperature or a temperature within a predetermined temperature range.

15. The gas compressor according to claim 1, wherein the electricity generation device configures a Rankine cycle by including an exhaust heat recovery heat exchanger for exchanging heat between the compressed gas compressed by the compressor body and the working fluid to cool the compressed gas and to heat and vaporize the working fluid, an expander driven by expanding the working fluid vaporized by the exhaust heat recovery heat exchanger, a condenser for cooling and condensing the working fluid sent from the expander and a circulating pump for supplying the working fluid condensed by the condenser to the exhaust heat recovery heat exchanger, and includes an electric generator driven by the expander to generate electricity.

16. The gas compressor according to claim 15, wherein the power generator is a DC generator, and DC power generated by the DC generator is supplied to the power consumption equipment via an AC converter.

17. The gas compressor according to claim 16, wherein the compressor unit includes an air-cooled heat exchanger for cooling the compressed gas compressed by the compressor body and discharged, and a cooling fan for sending cooling air to the air-cooled heat exchanger, and the power consumption equipment is a fan motor for driving the cooling fan.

18. The gas compressor according to claim 17, wherein the electric generator is a DC generator, the number of rotations of the fan motor for driving the cooling fan is controlled by supplying the power from the commercial power supply to the fan motor via an inverter, also DC power generated by the electricity generation device is supplied to the inverter, and the switch device for switching between the power generated by the electricity generation device and the power obtained from the commercial power supply so as to supply the power to the fan motor is incorporated into the inverter.

* * * * *